United States Patent [19]

Clement

[11] Patent Number: 4,937,954

[45] Date of Patent: Jul. 3, 1990

[54] GOLF SHOES

[75] Inventor: Shawn Clement, Westmount, Canada

[73] Assignee: Incredibal Inc., Westmount, Canada

[21] Appl. No.: 263,015

[22] Filed: Oct. 27, 1988

[51] Int. Cl.[5] ..... A43B 5/00

[52] U.S. Cl. ..... 36/127; 36/25 R

[58] Field of Search ..... 36/1, 25 R, 116, 127, 36/103, 104, 114, 133

[56] References Cited

U.S. PATENT DOCUMENTS

| | | | |
|---|---|---|---|
| 2,179,942 | 11/1939 | Lyne | 36/127 |
| 3,074,184 | 1/1963 | Litak | 36/25 R |
| 3,218,734 | 11/1965 | O'Brien | 36/127 |
| 3,410,005 | 11/1968 | Szerenyl | 36/127 |
| 3,614,107 | 10/1971 | Kinsey | 36/127 |
| 3,844,054 | 10/1974 | Morris | 36/1 |
| 3,936,896 | 2/1976 | Creamer | 36/116 |
| 4,149,324 | 4/1979 | Lesser | 36/127 |
| 4,407,079 | 10/1983 | Chiroff | 36/127 |
| 4,589,216 | 5/1986 | Fuscone | 36/25 R |
| 4,667,423 | 5/1987 | Autry | 36/25 R |
| 4,790,083 | 12/1988 | Dufour | 36/127 |

FOREIGN PATENT DOCUMENTS

| | | | |
|---|---|---|---|
| 1390372 | 1/1965 | France | 36/25 R |
| 1403889 | 5/1965 | France | 36/25 R |
| 13612 | 1/1897 | Switzerland | 36/25 R |
| 756453 | 9/1956 | United Kingdom | 36/25 R |

*Primary Examiner*—Werner H. Schroeder

*Assistant Examiner*—Diana L. Biefeld

*Attorney, Agent, or Firm*—Samuel Meerkreebs

[57] ABSTRACT

In a pair of golf shoes for a right-handed golfer, the invention being equally adaptable for shoes of a left-handed golfer, the shoes having a sole including toe, heel and intermediate metatarsal portions and inner and outer edges; the shoe edges being substantially linear; the left shoe having an outer linear edge from the heel portion to the metatarsal portion and an inner linear edge from the metatarsal portion to the toe portion and including at least part of the area of the ball of the golfer's left foot; the linear edges of the left shoe being parallel for promoting a proper weight transfer and body-swing motion to the golfer during a golf swing. The right shoe having aligned inner linear edges parallel to the sole longitudinal axis; the linear edges corresponding with at least a right heel portion and part of the metatarsal portion thereof corresponding to the inner ball portion of a golfer's right foot; the front edge of the right shoe being linear and perpendicular to the right sole longitudinal axis for promoting proper pivoting of the right foot of the golfer during the golf swing as well as promoting positive weight transfer of the golfer during the swing, the toe front edge assisting the golfer in aligning his feet when initially addressing a golf ball preparatory to initiating the golf swing as well as providing stability to the golfer's body during follow-through of the golf swing.

10 Claims, 2 Drawing Sheets

GOLF SHOES

BACKGROUND OF THE INVENTION

1. Field of the Invention

The present invention relates to golf shoes and, more particularly, to improvements to the soles thereof.

2. Description of the Prior Art

It is well known in the game of golf that a proper stance and a consistent swing represent the basis for a good and consistent play. Over the years, different attachments or devices have been developed for the golf shoes and tentatively introduced in the game of golf. These devices were basically aimed at assisting the golfer in his swing and at stabilizing the latter.

For instance, U.S. Pat. No. 2,179,942, issued Nov. 14, 1939 to Lyne, discloses devices which are provided with spikes and which are fixedly mounted to the inner edges of the front sole and of the heel of the left golf shoe. These attachments provide the inner left shoe with additional traction as it pivots inwardly during the upswing of the golfer.

In U.S. Pat. No. 3,218,734, issued Nov. 23, 1965 to O'Brien, a detachable device is slidably mounted at an outer metatarsal portion of the right golf shoe for forcing an inward tilt of the right shoe and a proper knee position.

In U.S. Pat. No. 3,614,107, issued Oct. 19, 1971 to Kinsey, a removable device planted in the ground prevents the left heel of the golfer from leaving the ground for only allowing an inner and an outer pivot of the heel during the swing.

In U.S. Pat. No. 4,407,079, issued Oct. 4, 1983 to Chiroff, a device having an arcuate surface is fixedly mounted to the left shoe at an outer metatarsal portion thereof for assisting the outer pivot of the left foot during the follow through of the golf swing.

In U.S. Pat. No. 4,149,324, issued Apr. 17, 1979 to Lesser et al., each golf shoe has a continuous sole from toe to heel that is at least partly bevelled inwardly and downwardly along the length of the inner and/or outer edge of the shoe.

The spike attachment disclosed in U.S. Pat. No. 2,179,942 gives transverse traction to the left shoe during the inner pivot thereof but does not provide longitudinal stability thereto as the outline thereof remains arcuate.

Both devices disclosed in U.S. Pat. Nos. 3,218,734 and 3,614,107 have to be removed between shots and are thus inconvenient. Moreover, as above, these devices do not provide substantial additional stability in the general longitudinal direction of the shoe. Both the device and golf shoe respectively disclosed in U.S. Pat. Nos. 4,407,079 and 4,149,324 assist in different pivots of the feet of the golfer with their ground engaging surfaces. These golf shoes are exclusively adapted for assisting the transverse rolling of the shoes during the pivots. The edges of each sole remain arcuate in the plane thereof and, thus, allow longitudinal rolling of the foot on the ground during the pivots thereof. The modifications made to the soles of the shoes disclosed in U.S. Pat. No. 4,149,324 are only adaptable to such shoes having a thick full sole from toe to heel. Firstly, this shoe model, even prior to the beveling of the soles, has not been adopted by many golfers. The conventional "street shoe" adapted with spikes is still the most popular. Secondly, the beveling of the soles greatly reduces the contact area of the shoe on the ground, the contact area for this shoe model is from the start lesser than that of the above mentioned conventional shoes. This reduced contact area renders walking uncomfortable and unstable. Since the soles are asymetrical and that this asymetry lies directly at the weight distribution level of the shoe, comfort thereof is even more impaired. More to the point, the longitudinal instability of the general golf shoe during the pivots thereof is not alleviated with the proposed soles of U.S. Pat. No. 4,149,324.

SUMMARY OF THE INVENTION

It is therefore an aim of the present invention to provide golf shoes each comprising a sole that is adapted for increasing the stability of the feet of the golfer, and more particularly the general longitudinal stability thereof, during the pivots thereof.

It is also an aim of the present invention to provide golf shoes each comprising a sole having long and linearly defined ground engaging edges with respect to the plane of the sole for increasing the longitudinal stability of the ground engaging edges, thus ensuring proper pivots of the feet of the golfer, a proper weight transfer and body motion thereof.

It is a further aim of the present invention to provide golf shoes adapted for properly aligning the golfer during the stance with respect to the target.

It is a still further aim of the present invention to provide a right golf shoe for a right-handed golfer that is adapted with a square front end portion for providing, at the end of the follow through, further stability to the right foot which is upstanding and which contacts the ground at the toe portion thereof.

A construction in accordance with the present invention comprises a pair of golf shoes including a first and a second shoe each having a sole. Each sole comprises toe, heel and intermediate metatarsal portions and further comprises inner and outer edges. The first shoe is adapted for a first foot of a golfer that will assume a stance position closest to a target. The inner and outer edges of the sole of the first shoe each include at least a part which is defined substantially linearly in the plane of the sole of the first shoe. The part of the inner edge of the sole of the first shoe extends substantially from the toe portion to the metatarsal portion corresponding at least with a part of the ball of the first foot. The part of the outer edge of the sole of the first shoe extends substantially from the heel portion to the metatarsal portion. The linear part of the edges of the sole of the first shoe are substantially parallel. The second shoe is adapted for a second foot of the golfer that will assume the stance position furthest from the target. The inner edge of the sole of the second shoe includes at least metatarsal and heel parts which are defined substantially linearly in the plane of the sole of the second shoe. A longitudinal axis of the sole of the second shoe extends through the heel portion corresponding to the heel of the second foot and through the metatarsal portion of the sole of the second shoe corresponding to one of the first and second metatarsal bones of the metatarsus of the second foot. The metatarsal and heel parts are substantially aligned and are substantially parallel to the longitudinal axis of the sole of the second shoe. The metatarsal part extends along at least a part of the metatarsal portion of the sole of the second shoe corresponding with the ball of the second foot. The heel part extends at least along a part of the heel portion of the sole of the second shoe. A front edge of the toe portion of the sole of the second shoe is substantially linearly defined in the plane of the sole of the second shoe and is substantially perpendicular to the longitudinal axis of the sole of the second shoe.

BRIEF DESCRIPTION OF THE DRAWINGS

Having thus generally described the nature of the invention, reference will now be made to the accompanying drawings, showing by way of illustration a preferred embodiment thereof, and in which:

FIG. 5 is a perspective view showing the position of the feet of the golfer at the end of the follow through;

DESCRIPTION OF THE PREFERRED EMBODIMENTS

The following embodiments describe a pair of golf shoes according to the present invention that are adapted for a right-handed golfer G. These golf shoes each comprise a conventional golf upper made of leather or of a water-repellent material and further comprise conventional golf spikes disposed in a conventional pattern.

Figure 1A:
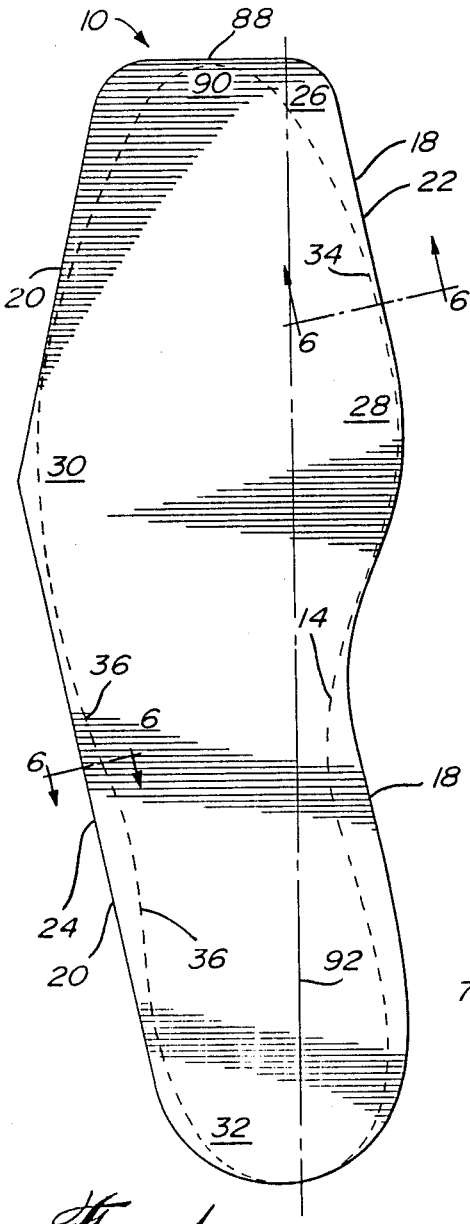
FIG. 1*a* is a top plan view of a sole of a left golf shoe according to the present invention and in which the dotted lines show a conventional sole outline.
Figure 1B:
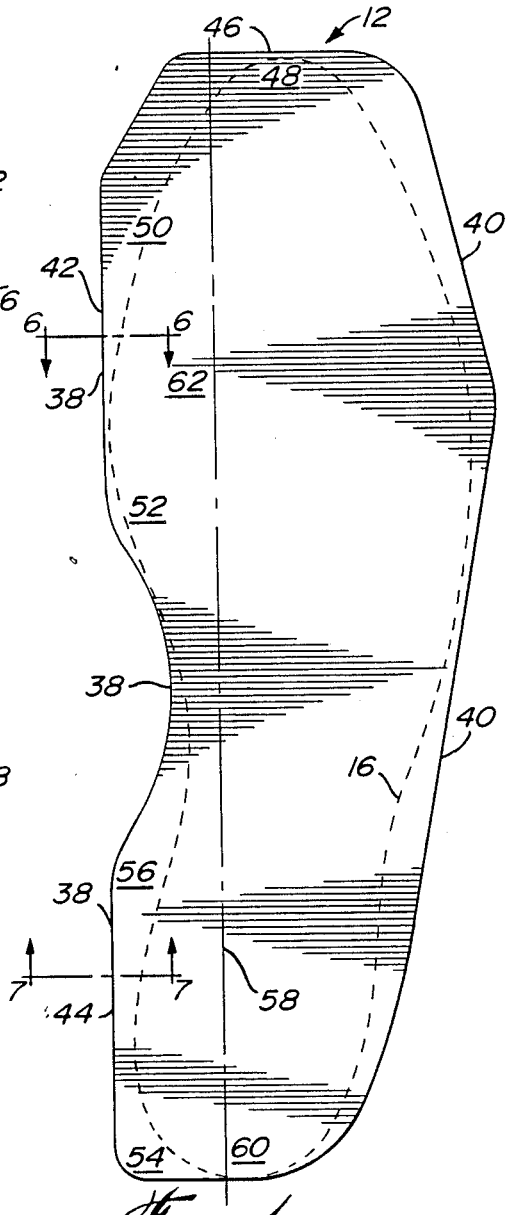
FIG. 1*b* is a top plan view similar to FIG. 1*a*, but showing a sole of a right golf shoe.

Accordingly, FIGS. 1*a* and 1*b* respectively show a left and a right sole 10 and 12 respectively adapted for a left shoe LS and a right shoe RS. The dotted lines generally indicated by 14 and 16 illustrate a general outline of conventional soles. Now referring to FIG. 1*a*, the left sole 10 includes inner and outer edges 18 and 20 respectively. The inner and outer edges 18 and 20 each include respective parts 22 and 24 which are linearly defined in the plane of the left sole 10. The inner linear part 22 substantially extends from an inner toe portion 26 of the left sole 10 to an inner metatarsal portion 28 thereof which at least partly corresponds with the ball of the left foot of the golfer G.

The outer linear part 24 substantially extends from an outer metatarsal portion 30 of the left sole 10 to an outer rear heel portion 32 thereof. Both the inner and outer linear parts 22 and 24 generally follow the corresponding edges 34 and 36 respectively of the conventional outline 14. Furthermore, the inner and outer linear parts 22 and 24 are substantially parallel.

Now referring to FIG. 1*b*, the right sole 12 includes inner and outer edges 38 and 40 respectively. The inner edge 38 includes first and second parts 42 and 44 respectively which are linearly defined in the plane of the right sole 12. Moreover, a front edge 46 of a toe section 48 of the right sole 12 is also linearly defined in the plane thereof.

The first linear part 42 of the inner edge 38 of the right sole 12 extends from an inner front metatarsal portion 50 to an inner rear metatarsal portion 52. The inner first linear part 42 at least corresponds with the ball of the right foot of the golfer G. The inner second linear part 44 of the inner edge 38 of the right sole 12 substantially extends from an inner rear heel portion 54 to an inner front heel portion 56 thereof.

Both the inner first and second linear parts 42 and 44 are substantially parallel to a longitudinal axis 58 of the right sole 12 which extends through a middle heel portion 60 of the right sole 12 and through a metatarsal portion 62 which corresponds to the first and the second metatarsal bones of the metatarsus of the right foot RF. The front edge 46 of the toe portion 48 is substantially perpendicular to the longitudinal axis 58. The inner first and second linear parts 42 and 44 of the inner edge 38 of the right sole 12 are aligned.

Figure 2:
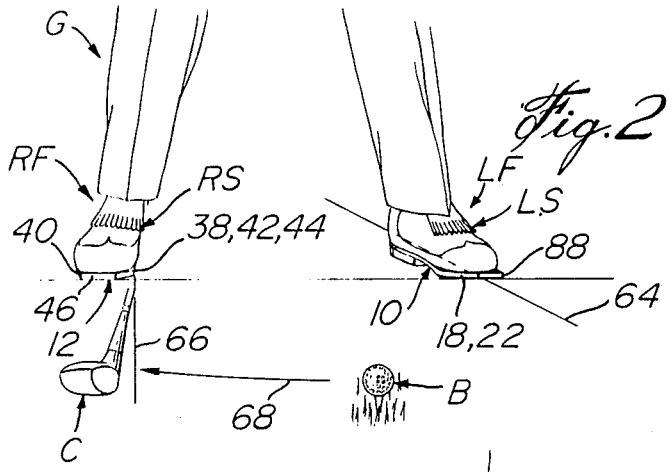
FIG. 2 is a perspective view showing the position of the feet of the golfer at the start of the upswing.

FIG. 2 shows the stance of the golfer G, meaning his feet position as he addresses the ball. For ensuring a proper stance, the body of the golfer G has to face in a direction that is substantially perpendicular to that of the target. For doing so, the right foot RF of the golfer G has to be perpendicular to the target, meaning that the longitudinal axis 58 has to be at right angles to the target. The linear front edge 46 of the toe portion 48 of the right sole 12 is thus used as well as the inner first and second linear parts 42 and 44 thereof. To ensure a proper stance, the golfer G simply steps into his address position by firstly positioning his right foot RF down at right angles to the target by aligning the front edge 46 of the toe portion 48 therewith and by then stepping in with his left foot LF slightly open. The front edge 46 thus assists in positioning the right foot RF perpendicular to the target for ensuring a proper target line of the body of the golfer G. The left shoe LS is frontwardly and outwardly open at an angle that varies substantially between 15° and 30° for ensuring a proper follow through of the body towards the target. A projected pivot line 64 indicates that the left shoe LS is substantially in full contact with the ground, whereas a projected pivot line 66 shows that the pressure on the right foot RF is somewhat concentrated on the inner first and second linear parts 42 and 44 of the inner edge 38 of the right sole 12. The feet position as shown in FIG. 2 are that intended for the stance and for the start of the upswing, that being in the direction shown by an arrow 68.

Figure 3:
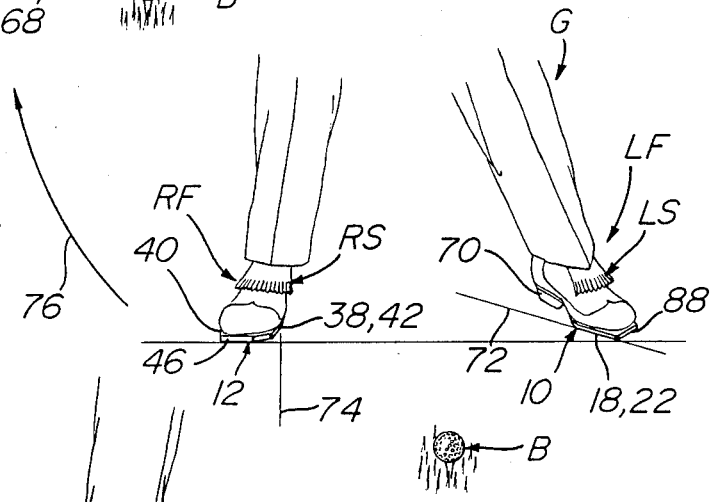
FIG. 3 is a perspective view showing the position of the feet of the golfer substantially at the end of the upswing.

FIG. 3 illustrates the position of the left foot LF and the right foot RF respectively of the golfer G at the end of the upswing. At that point, the golfer G attempts to maintain pressure on the inner first and second linear parts 42 and 44 of the inner sole edge 38 of the right shoe RS, as he did prior to and at the start of the upswing. During the upswing, the left heel 70 of the left shoe LS leaves the ground as the left foot LF pivots along the inner linear part 22 of the inner left edge 18 of the left shoe LS. The inner linear part 22 is, during that pivot, fully in contact along the whole length thereof with the ground for providing a longitudinal stability to the left foot L(. A projected pivot line 72 shows the pivot of the left foot LF with respect to the ground during the upswing. A projected pivot line 74 illustrates that pressure of the right foot RF is still concentrated on the inner first and second linear parts 42 and 44 of the sole 12 of the right shoe RS. The position of the feet shown in FIG. 3 corresponds with the end part of the upswing as generally indicated by an arrow 76.

Figure 4:
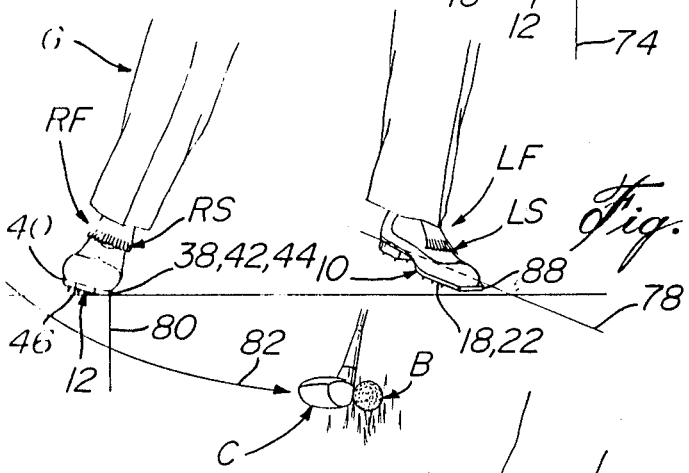
FIG. 4 is a perspective view showing the position of the feet of the golfer during the downswing.

For the downswing, the position of the feet is shown in FIG. 4. The linearity of the inner linear part 22 of the sole 10 of the left foot LF assists the left foot LF in returning to a same ground position as that seen in FIG. 2 before engaging in an outward pivot thereof, meaning in the weight transfer. The inner and outer linear parts 22 and 24 respectively of the sole 10 are parallel for ensuring the straightest possible lateral movement of the left side of the body of the golfer G as the left knee is thrown outwardly and the hips cleared before the impact, thus providing more power and more control. During the weight transfer, the weight on the left foot LF shifts from the inner linear part 22 of the left sole 10 to the outer linear part 24 thereof. A projected pivot line 78 indicates that the pressure on the left foot LF is on the outer linear part 24 of the sole 10 of the left shoe LS as the inner edge 18 thereof is slightly raised from the ground. At that point, the weight on the right foot RF lies entirely on the inner first and second linear parts 42 and 44 of the right sole 12, as indicated by a projected pivot line 80. An arrow 82 indicates that the position of the feet shown in FIG. 4 corresponds to the weight transfer part of the swing. The inner first and second linear parts 42 and 44 of the right sole 12 are square for producing a superior pushing action from the right foot RF and a better lateral weight transfer into a ball B. Furthermore, the inner first and second linear parts 42 and 44 assist in propelling the body of the golfer G towards the target. The parallelism of the inner and outer linear parts 22 and 24 of the left sole 10 of the left foot LF assist in counteracting the propensity to transfer the weight to the front of the left foot LF. Furthermore, during the weight transfer, the left knee moves more quickly into position for moving the hips out of the way of the path of the swing thus generating more headspeed from a club C into the ball B, which results in a greater swing torque and thus greater distance.

Figure 5:
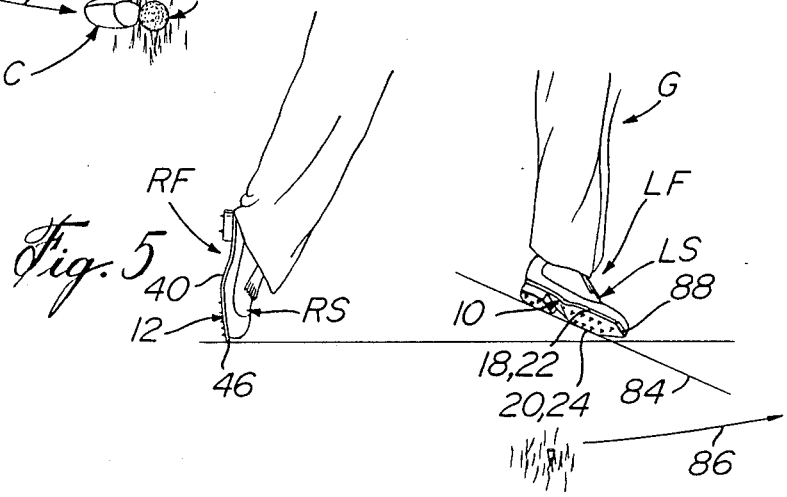

At the end of the follow through, the weight of the left foot LF is entirely on the outer linear part 24 of the edge 20 of the left shoe LS, as can be seen by a projected pivot line 84 in FIG. 5. Again, the linearity of the outer linear part 24 ensures longitudinal stability of the left foot LF during the follow through till the end thereof. At the end of the follow through, the right foot RF is upstanding, pointing towards the ground. The linearity of the front edge 46 of the toe portion 48 of the right shoe RS prevents the same from oscillating about the contact area of the right shoe RS with the ground. The right foot RF being square to the ground and thus stable ensures that the hips are squarely facing the target towards the end of the follow through and at the end thereof, thus ensuring greater accuracy. The linearity of the front edge 46 of the toe portion 48 of the right shoe RS thus assists in stabilizing the upstanding right foot RF for ensuring a proper finish position of the swing which is necessary for accuracy. An arrow 86 indicates that the feet position shown in FIG. 5 corresponds to the follow through and, more particularly, to the end thereof.

A front edge 88 of a general toe portion 90 of the left sole 10 is substantially linearly defined in the plane of the left sole 10. The front edge 88 is substantially perpendicular to a longitudinal axis 92 of the left sole 10. Therefore, the linear front edges 46 and 88 of right and left soles 12 and 10 respectively may also assist the golfer G when he positions himself and lines up for putting or chipping. A bottom of the club C simply has to be perpendicular to the target line which in turn is easier found with the linearity of the front edges 46 and 88.

Figure 6:
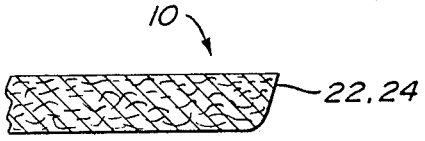
FIG. 6 is an enlarged cross-sectional view taken along line 6—6 of FIGS. 1*a* and 1*b* showing a downward and inward bevel of the soles of the golf shoes.
Figure 7:
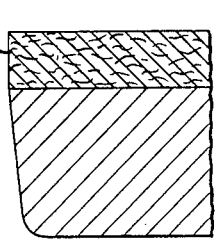
FIG. 7 is an enlarged cross-sectional view taken along line 7—7 of FIG. 1*b* showing a downward and inward bevel of the heel of the right shoe.

Now referring to FIGS. 6 and 7, the inner and outer linear parts 22 and 24 respectively of the left sole 10 and the inner linear parts 42 and 44 of the right sole 12 may be downwardly and inwardly bevelled for providing smoother ground engaging surfaces for the pivots associated therewith.

Other embodiments of the present invention, which are not shown, introduce a left heel that is outwardly narrower than the corresponding heel portion of the sole. The outer edge of the heel would thus not extend as far as the corresponding edge of the sole for facilitating the outward pivot of the left foot LF during the weight transfer.

In a further embodiment, the inner linear parts 42 and 44 of right sole 12 may be unified in order that the linear part of the inner edge 38 substantially extends the length thereof.

To summarize, the present golf shoes therefore assist in stabilizing the different pivots of the feet during a complete swing. These golf shoes make for a better weight transfer and body propulsion for better accuracy and longer distance, and further assist in positioning the golfer for the stance.

The present golf shoes are asymetrically designed with respect to the edges of the soles thereof for the specific purpose of an asymetrical game as opposed to conventional golf shoes which are modified symetric street shoes. The basic comfort of these conventional shoes is not impaired by the above-described sole design.

I claim:

1. A pair of golf shoes comprising a first and a second shoe each having a sole, each sole comprising toe, heel and intermediate metatarsal portions and further comprising inner and outer edges; said first shoe being adapted for a first foot of a golfer that will assume a stance position closest to a target, said inner and outer edges of said sole of the first shoe each including at least a part which is defined substantially linearly in the plane of said sole of the first shoe, said part of said inner edge of said sole of the first shoe extending substantially from said toe portion to said metatarsal portion corresponding at least with a part of the ball of the first foot, said part of said outer edge of said sole of the first shoe extending substantially from said heel portion to said metatarsal portion; the linear parts of said edges of said sole of the first shoe being substantially parallel; said second shoe being adapted for a second foot of the golfer that will assume the stance position furthest from said target, said inner edge of said sole of the second shoe including at least metatarsal and heel parts which are defined substantially linearly in the plane of said sole of the second shoe; a longitudinal axis of the sole of the second shoe extending through the heel portion thereof corresponding to the heel of said second foot and through the metatarsal portion of the sole of the second shoe corresponding to one of the first and second metatarsal bones of the metatarsus of said second foot, said metatarsal and heel parts being substantially aligned and being substantially parallel to said longitudinal axis of said sole of the second shoe, said metatarsal part extending along at least a part of said metatarsal portion of the sole of the second shoe corresponding with the ball of the second foot, said heel part extending at least along a part of said heel portion of the sole of the second shoe; a front edge of said toe portion of said sole of the second shoe being substantially linearly defined in said plane of said sole of the second shoe and being substantially perpendicular to said longitudinal axis thereof.

2. In a pair of golf shoes as defined in claim 1, wherein said linear parts of said inner and outer edges of said sole of said first shoe and said metatarsal and heel parts of said sole of said second shoe are bevelled inwardly and downwardly for facilitating pivots associated therewith.

3. In a pair of golf shoes as defined in claim 1 or 2, wherein a front edge of said toe portion of said sole of the first shoe is substantially linearly defined in said plane thereof, a longitudinal axis extending through the heel portion corresponding to the heel of said first foot and through the metatarsal portion of the sole corresponding to one of the first and second metatarsal bones of the metatarsus of said first foot, said front edge of said sole of the first shoe being substantially perpendicular to said longitudinal axis of said sole of the first shoe.

4. In a pair of golf shoes as defined in claim 1, wherein each shoe comprises a conventional golf upper, said upper being made of one of a leather material and a water-repellent material.

5. In a pair of golf shoes as defined in claim 1, wherein each shoe is provided with conventional golf spikes disposed in a conventional pattern.

6. In a golf shoe for a foot of a golfer that will assume a stance position closest to a target comprising a sole including toe, heel and intermediate metatarsal portions, an inner edge of said sole being substantially linearly defined in the plane of said sole from said toe portion to said metatarsal portion corresponding at least with a part of the ball of the foot, thereby ensuring during the upswing a proper inner pivot of a front part of said shoe on a ground surface.

7. In a golf shoe as defined in claim 6, wherein, an outer edge of said sole is substantially linearly defined in the plane of said sole from said heel portion to said metatarsal portion, thereby ensuring during the downswing a proper outer pivot of a rear part of said shoe on the ground surface.

8. In a golf shoe for a foot of a golfer that will assume a stance position furthest from a target comprising a sole including toe, heel and intermediate metatarsal portions, an inner edge of said sole being substantially linearly defined in the plane of said sole substantially at least along a part of said heel portion and at least along a part of said metatarsal portion corresponding with the ball of the foot; a longitudinal axis of said sole extending through the heel portion thereof corresponding to the heel of said foot and through the metatarsal portion of said sole corresponding to one of the first and second metatarsal bones of the metatarsus of said foot, the linear parts of said inner edge being substantially parallel to said longitudinal axis of said foot and being substantially aligned, thereby providing stability to a transverse inner pivot of said shoe on a ground surface, said linear parts of said inner edge further assisting in a weight transfer of the golfer.

9. In a golf shoe for a foot of a golfer that will assume a stance position furthest from a target comprising a sole including toe, heel and intermediate metatarsal portions, a front edge of said toe portion of said sole being substantially linearly defined in the plane of said sole and being substantially perpendicular to a longitudinal axis of said sole extending through the heel portion thereof corresponding to the heel of said foot and through the metatarsal portion of said sole corresponding to one of the first and second metatarsal bones of the metatarsus of said foot, thereby ensuring a proper substantially perpendicular position of said sole with respect to said target at said stance and further ensuring that the foot at the end of follow-through is substantially upstanding and that an upper part thereof substantially faces the target, said front edge of said toe portion providing stability to said foot which is squarely in contact with a ground surface at said front edge of said toe portion.

10. In a golf shoe for a foot of a golfer that will assume a stance position closest to a target comprising a sole including toe, heel and intermediate metatarsal portions, an inner edge of said sole being substantially linearly defined in the plane of said sole from said toe portion to said metatarsal portion corresponding at least with a part of the ball of the foot, thereby ensuring during the upswing a proper inner pivot of a front part of said shoe on a ground surface, an outer edge of said sole being substantially linearly defined in the plane of said sole from said heel portion to said metatarsal portion, thereby ensuring during the downswing a proper outer pivot of a rear part of said shoe on the ground surface, wherein the linear parts of said inner and outer edges are substantially parallel, thereby ensuring a proper weight transfer and body motion of the golfer towards the target.

* * * * *